US009096964B2

(12) United States Patent
Albayrak et al.

(10) Patent No.: US 9,096,964 B2
(45) Date of Patent: Aug. 4, 2015

(54) METHOD AND CIRCUIT ARRANGEMENT FOR DETERMINING THE LOAD AND/OR UNBALANCE OF A LAUNDRY DRUM OF A WASHING MACHINE

(75) Inventors: Hasan Gökcer Albayrak, Berlin (DE); Torsten Böttger, Radebeul (DE); Jörg Skrippek, Wustermark (DE)

(73) Assignee: BSH Hausgeräte GmbH, Munich (DE)

( * ) Notice: Subject to any disclaimer, the term of this patent is extended or adjusted under 35 U.S.C. 154(b) by 900 days.

(21) Appl. No.: 13/254,004

(22) PCT Filed: Feb. 18, 2010

(86) PCT No.: PCT/EP2010/052015

§ 371 (c)(1),
(2), (4) Date: Aug. 31, 2011

(87) PCT Pub. No.: WO2010/100030

PCT Pub. Date: Sep. 10, 2010

(65) Prior Publication Data

US 2011/0314875 A1 Dec. 29, 2011

(51) Int. Cl.
*D06F 33/02* (2006.01)
*D06F 37/20* (2006.01)
(Continued)

(52) U.S. Cl.
CPC ..... *D06F 33/02* (2013.01); *D06F 37/203* (2013.01); *D06F 37/30* (2013.01); *D06F 37/304* (2013.01); *D06F 39/003* (2013.01)

(58) Field of Classification Search
USPC ..... 68/12.02, 12.04, 12.06, 140
See application file for complete search history.

(56) References Cited

U.S. PATENT DOCUMENTS

2002/0116961 A1* 8/2002 Kim et al. ..... 68/23.7
2005/0050646 A1 3/2005 Lee et al.
(Continued)

FOREIGN PATENT DOCUMENTS

EP 1548169 A1 6/2005
EP 2009169 A2 12/2008
(Continued)

OTHER PUBLICATIONS

Report of Examination Including National Search Report CN 201080010229.3 Dated Feb. 17, 2013.
(Continued)

*Primary Examiner* — Joseph L Perrin
*Assistant Examiner* — Levon J Shahinian
(74) *Attorney, Agent, or Firm* — Nixon & Vanderhye, P.C.

(57) ABSTRACT

In a method for determining a load and/or an unbalance of a laundry drum of a washing machine driven by an electric motor having a stator with at least one winding coupled to a power inverter controlled by a control unit, the laundry drum is accelerated to a predetermined rotational speed and then slowed down. During the slow-down, the motor operates in generator mode and an electric current flowing through the at least one winding and/or an electric intermediate circuit voltage is measured. The time dependence of the electric power supplied by the electric motor in generator mode is evaluated during a revolution of the laundry drum. The unbalance and/or the load are determined from the measured current values and/or the intermediate circuit voltage and from the determined electric power. A corresponding circuit arrangement and a washing machine with this circuit arrangement are also disclosed.

11 Claims, 2 Drawing Sheets

(51) Int. Cl.
*D06F 37/30* (2006.01)
*D06F 39/00* (2006.01)

(56) References Cited

U.S. PATENT DOCUMENTS

| | | | | |
|---|---|---|---|---|
| 2005/0143940 | A1 | 6/2005 | Zeh et al. | |
| 2005/0204482 | A1 * | 9/2005 | Murray et al. | 8/158 |
| 2006/0021392 | A1 | 2/2006 | Hosoito et al. | |
| 2006/0042328 | A1 | 3/2006 | Komatsu et al. | |
| 2006/0242768 | A1 | 11/2006 | Zhang et al. | |

FOREIGN PATENT DOCUMENTS

| | | | |
|---|---|---|---|
| JP | 9253379 | A | 9/1997 |
| JP | 11000492 | A | 1/1999 |

OTHER PUBLICATIONS

International Search Report PCT/EP2010/052015.
National Search Report DE 10 2009 001 271.0.

* cited by examiner

METHOD AND CIRCUIT ARRANGEMENT FOR DETERMINING THE LOAD AND/OR UNBALANCE OF A LAUNDRY DRUM OF A WASHING MACHINE

This application is a U.S. National Phase of International Patent Application No. PCT/EP2010/052015, filed Feb. 18, 2010, which designates the U.S. and claims priority to German Patent Application No. DE 10 2009 001 271.0, filed Mar. 2, 2009, the entire contents of each of which are hereby incorporated by reference.

BACKGROUND OF THE INVENTION

The invention relates to a method for obtaining information about the load and/or unbalance of a laundry drum of a washing machine, with the laundry drum being driven by an electric motor. The stator of the electric motor comprises at least one winding that is coupled to a power inverter, which can also be referred to as an inverter, controlled by a control unit. The invention also relates to a circuit arrangement for determining the unbalance and/or the load of a laundry drum. Finally, the invention relates to a washing machine having such a circuit arrangement.

It is the prior art to determine the load and the unbalance of the laundry drum of a washing machine during a washing cycle. Reference is made here to the publication EP 1 512 785 A1, in which a method for determining the load of the laundry drum is described. With this method, the load is determined after completion of a resistance braking and a regenerative braking, with which energy fed back by the electric motor is stored. In other words, with the known method both the resistance braking and also the regenerative braking are needed in order to be able to determine the load of the laundry drum.

BRIEF SUMMARY OF THE INVENTION

It is the object of the invention to indicate a solution as to how the load and/or the unbalance of the laundry drum can be particularly precisely and quickly determined.

This object is achieved in accordance with the invention by a method having the features according to the invention and by a circuit arrangement having the features according to the invention, and also by a washing machine having the features according to the invention. Advantageous embodiments of the invention form the subject matter of the dependent claims.

With an inventive method, information is obtained about the load and/or the unbalance of a laundry drum of a washing machine. The laundry drum is driven here by means of an electric motor, the stator of which comprises at least one winding, which is coupled to a power inverter controlled by a control unit. With the method, the laundry drum is accelerated to a predetermined rotational speed. The laundry drum is then slowed down, i.e. a changeover from a motor operation into a generator operation of the electric motor takes place. When slowing down the laundry drum, in other words in generator operation, an electric current flowing over the at least one winding of the stator and/or an electric intermediate circuit voltage are measured. Furthermore, a curve of the electric power supplied by the electric motor during generator operation is evaluated for the duration of a revolution of the laundry drum in each instance. The unbalance and/or the load of the laundry drum are concluded as a function of the measured values for the current and/or for the intermediate circuit voltage and as a function of the power.

Provision is thus made in accordance with the invention to use the current and/or the intermediate circuit voltage flowing over the winding of the stator to determine the load and/or the unbalance of the laundry drum. The fact is used here that the current and the intermediate circuit voltage flowing over the winding in generator operation represent a measure of the moment of inertia of the laundry drum and thus of its load. This connection applies in particular immediately after the changeover into the generator operation—it is therefore advantageous if the determination of the load and/or the unbalance is introduced with this changeover. The measurement of the current and/or the intermediate circuit voltage can also begin with this changeover or immediately thereafter. The measurement of the current and/or the intermediate circuit voltage may however additionally also take place during the motor operation. By means of the power supplied during generator operation of the electric motor, it is possible to determine the degree by which the current and/or the intermediate circuit was influenced on the one hand by the load or on the other hand by the unbalance. The unbalance and the load can therefore advantageously also be defined precisely for one another respectively.

A permanently excited synchronous motor is preferably used as an electric motor. Such synchronous motors are, as is well-known, characterized by high degrees of efficiency e.g. asynchronous motors. A high degree of efficiency enables the electric motor to be embodied in a compact fashion, so that advantages with regards to costs can be achieved on account of the material savings. Such a permanently excited synchronous motor can be used for instance, the stator of which is embodied in three phases and thus comprises a total of three windings, so-called phase strands. Currents are preferably measured in all windings of the stator and evaluated with regards to the load and/or the unbalance of the laundry drum. With a three phase stator, measured values are then available for a total of three currents in order to determine the load and/or the unbalance. The results of this determination can then be compared with one another. With a permanently excited synchronous motor, it is also advantageous for the currents flowing into the phase strands to be able to be precisely detected by means of the inverter with very little effort.

Provision can be made for the measured values for the current and/or for the intermediate circuit voltage to be compared with values stored in a memory of the control unit. As a function of the output of this comparison, the load and/or the unbalance can then be determined. The values stored in the memory can be defined by tests during a development phase of the washing machine. With this embodiment, a relationship of the load and/or the unbalance with respect to the measured values for the current and/or for the intermediate circuit voltage is modeled in other words. It may therefore appear for instance that several value ranges are predetermined for the current and/or for the intermediate circuit voltage, each of which is assigned in each instance to a load of the laundry drum. If the intensity of current of the measured current and/or the amplitude of the intermediate circuit voltage falls into a predetermined value range, the load assigned to this value range can therefore be immediately read off.

It has proven particularly advantageous if an energy supplied by the electric motor within a predeterminable time interval when slowing the laundry drum down, in other words during the generator operation, is calculated by using the measured values for the current and/or for the intermediate circuit voltage and if the load and/or the unbalance is/are determined from this energy. While the energy supplied by the electric motor can either be calculated alone from the intermediate circuit voltage or from the measured current, a high accuracy and high resolution during the determination of the load and/or the unbalance can nevertheless be achieved in particular if the energy is calculated both from the intermediate circuit voltage and also from the current. This calculation can take place for instance by means of a simple multiplication.

Therefore the energy supplied within the predeterminable time interval by the electric motor during generator operation is available as a basis for the determination of the unbalance and/or the load. A relationship of the unbalance and/or the load to the calculated energy can now be modeled in the control unit. Two paths are now provided for this modeling; the modeling of this relationship can take place by means of a mathematical function. Alternatively or in addition, this relationship can be modeled by means of a characteristic curve.

The fact is utilized in particular in that the moment of inertia of the laundry drum is directly dependent on its load. The moment of inertia can be determined by using the measured values for the current and/or for the intermediate circuit voltage and can be used as a measure of the load of the laundry drum. It may therefore appear for instance that the moment of inertia of an unloaded laundry drum is stored in a memory of the control unit and the moment of inertia of the loaded laundry drum is determined during generator operation. The moment of inertia effected by the load of the laundry drum can then be calculated as a measure of the load by means of a simple subtraction.

A curve of the power supplied by the electric motor during generator operation is preferably evaluated for the duration of a revolution of the laundry drum, and the unbalance of the laundry drum is determined as a function of this curve. The fact is utilized here in that the unbalance of the laundry drum can be detected with the aid of a fluctuation in the curve of the power for the duration of a drum revolution. The fluctuation in this curve then represents a direct measure of the unbalance of the laundry drum.

Furthermore, provision is made in accordance with the invention for a circuit arrangement for determining the unbalance and/or the load of a laundry drum of a washing machine. The circuit arrangement includes an electric motor, which can be operated using a generator. The stator of the electric motor comprises at least one winding. The circuit arrangement also includes a power inverter for providing an electrical alternating voltage to the at least one winding of the stator. Furthermore, the circuit arrangement includes a control unit for controlling the power inverter. The control unit is embodied here so as to measure an electric current and/or an intermediate circuit voltage flowing over the winding of the stator during generator operation of the electric motor and to determine the load and/or the unbalance of the laundry drum as a function of measured values for the current and/or the intermediate circuit voltage.

The preferred embodiments and their advantages presented with respect to the inventive method apply accordingly to the inventive circuit arrangement.

A washing machine with an inventive circuit arrangement finally forms part of the invention.

Further features of the invention result from the claims, the figures and the description of the figures. The features and feature combinations cited above in the description as well as the features and feature combinations subsequently cited in the description of the figures and/or shown solely in the figures can not only be used in the claimed combination in each instance but can also be used in other combinations or alone without departing from the scope of the invention.

BRIEF DESCRIPTION OF THE DRAWINGS

The invention is now described in more detail with the aid of a preferred exemplary embodiment and with reference to the drawings in which.

DETAILED DESCRIPTION OF EXEMPLARY EMBODIMENTS OF THE PRESENT INVENTION

Figure 1:
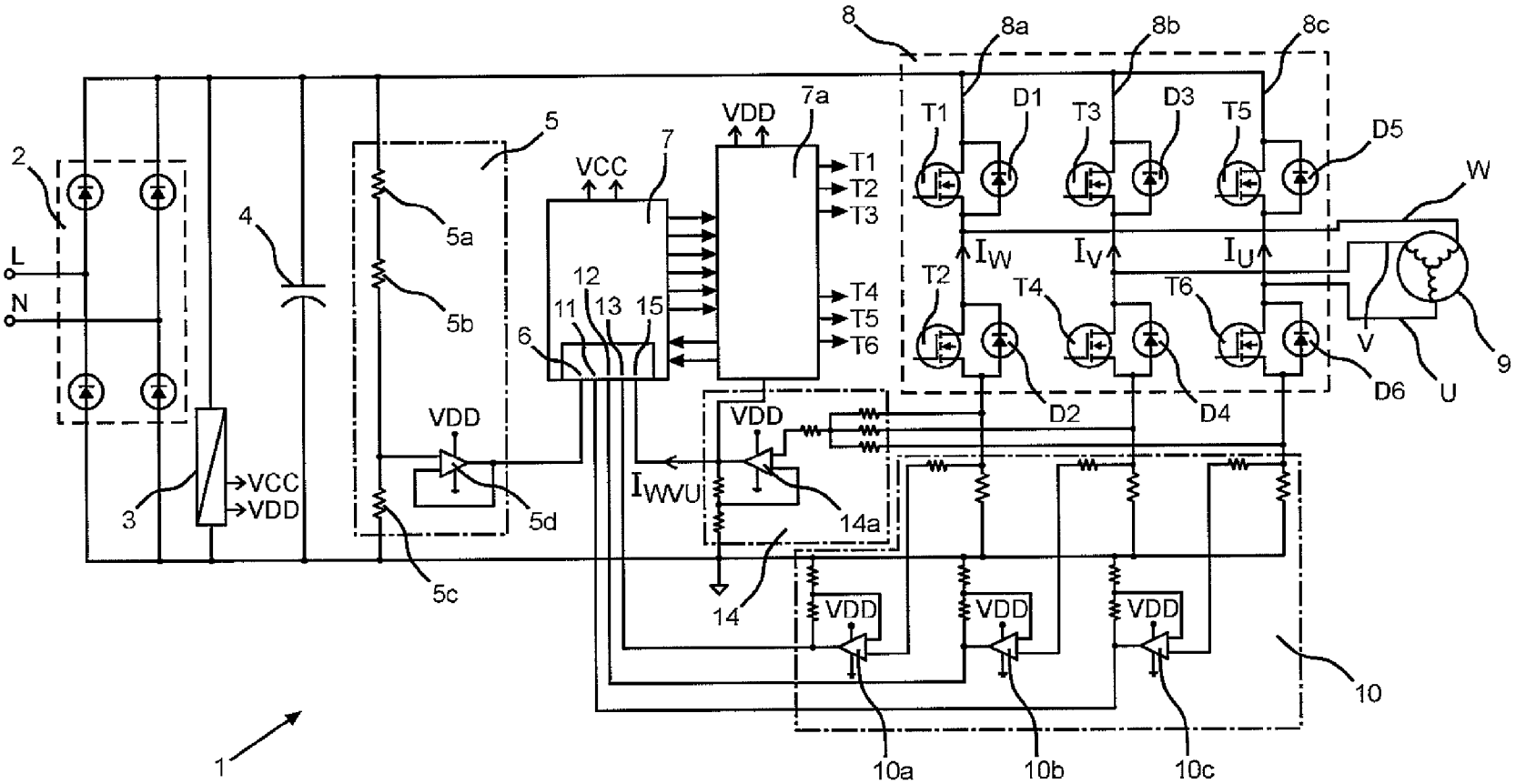
FIG. 1 illustrates a circuit arrangement according to an embodiment of the invention and FIG. 2 shows a graph of a current flowing over a winding of a stator of a synchronous motor during generator operation.

A circuit arrangement 1 shown in FIG. 1 is used to operate a washing machine. The circuit arrangement 1 includes a bridge rectifier 2 on the input side with a total of four diodes, said bridge rectifier being connected to terminals L, N. A DC/DC converter 3 is connected in parallel to the bridge rectifier 2, by means of which supply voltages VCC and VDD are provided for the circuit arrangement 1. An intermediate circuit capacitor 4 is connected in parallel to the bridge rectifier 2 and to the DC/DC converter 3. A voltage divider 5 is connected in parallel to the intermediate circuit capacitor 4. The voltage divider 5 includes three resistors 5*a*, 5*b*, 5*c* and an impedance converter 5*d*. The impedance converter 5*d* is formed by an operations amplifier, the output of which is coupled to a first input 6 of a control unit 7. The control unit 7 is a microprocessor in the example. The control unit 7 can detect and evaluate the electrical intermediate circuit voltage applied to the intermediate circuit capacitor 4 over the first input 6. The intermediate circuit voltage is therefore measured by means of the control unit 7 with the aid of the voltage divider 5.

An inverter 8, as a power inverter, is also connected in parallel to the bridge rectifier 2. The inverter 8 has the task of converting the rectified supply voltage into an alternating voltage. For this purpose, the inverter 8 includes six bipolar transistors T1 to T6 with an insulated gate electrode (IGBT). A diode D1 to D6 is connected in parallel to each bipolar transistor T1 to T6 in each instance. The transistors T1 to T6 are controlled by means of the control unit 7 by way of a driver circuit 7*a*. The inverter 8 is used to drive a permanently excited synchronous motor and/or a brushless direct current motor 9, the stator of which, as shown schematically in FIG. 1, is embodied in three phases, and thus comprises three windings W, V, U. The rotor of the synchronous motor 9 is mechanically coupled to a laundry drum of the washing machine by way of a belt. The inverter 8 is subdivided into three circuit branches 8*a*, 8*b*, 8*c*, with each circuit branch 8*a*, 8*b*, 8*c* including two bipolar transistors T1 and T2, T3 and T4, T5 and T6 which are connected in series with one another in each instance. The windings W, V, U of the stator are coupled to a circuit branch 8*a*, 8*b*, 8*c* of the inverter 8 in each instance.

A measuring facility 10 is provided in the circuit arrangement 1 in order to measure phase currents $I_W$, $I_V$, $I_U$ flowing over the windings W, V, U during generator operation of the synchronous motor 9. The measuring facility 10 is used to tap the currents $I_W$, $I_V$, $I_U$ flowing in the windings W, V, U and/or the circuit branches 8*a*, 8*b*, 8*c* separately and to transfer the same via an impedance converter 10*a*, 10*b*, 10*c* to an input 11, 12, 13 of the control unit 7 in each instance. With a further measuring facility 14, a total current $I_{WVU}$ is formed from currents $I_W$, $I_V$, $I_U$ of all windings W, V, U and is output to an input 15 of the control unit 7 by way of an impedance converter 14*a*. The total current $I_{WVU}$ normally amounts here to 0 A on account of the phase shift of the currents $I_W$, $I_V$, $I_U$. If there is no longer any phase symmetry between the currents $I_W$, $I_V$, $I_U$, then this fault can therefore be determined with the aid of the intensity of current of the total current $I_{WVU}$.

A method according to an embodiment of the invention makes use of the circuit arrangement 1, as shown in FIG. 1. With the method, the load and the unbalance of the laundry drum are determined by means of the control unit 7. This takes place during generator operation of the synchronous motor 9. With the method, the fact is utilized that the intensity of current of the currents $I_W$, $I_V$, $I_U$ flowing in the windings W, V, U and thus in the circuit branches 8*a*, 8*b*, 8*c*, each represent a measure of the load and the unbalance of the laundry drum. The intermediate circuit voltage, which is applied to the intermediate circuit capacitor 4 during generator operation, and/or an increase in this voltage during the changeover from the motor operation into the generator operation represent/s a measure of the load and the unbalance.

Figure 2:
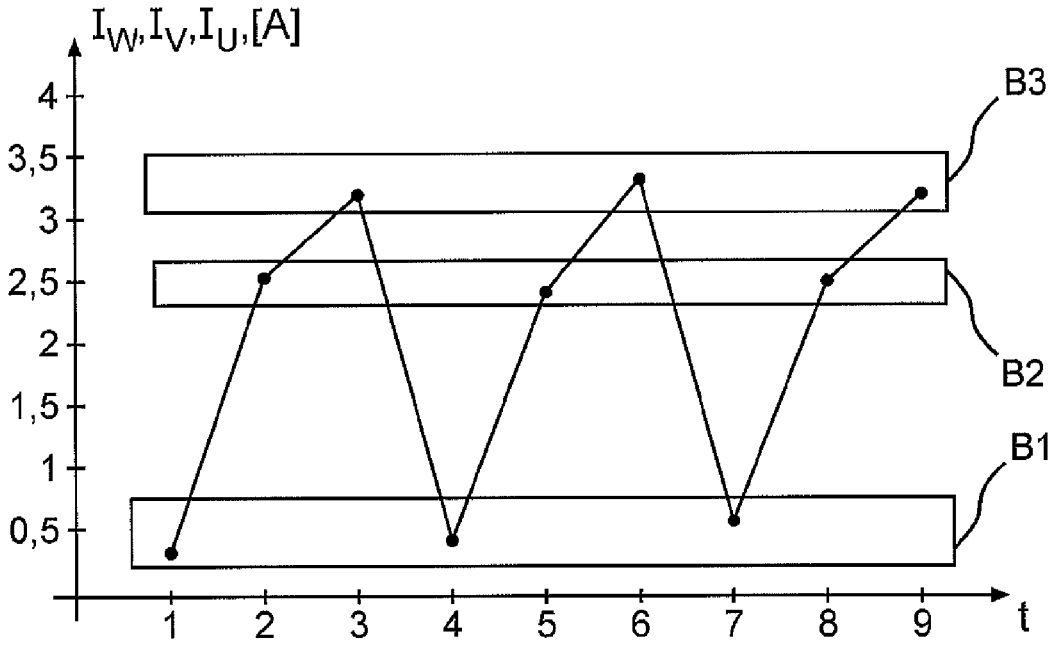

In order to determine the load of the laundry drum, the current $I_W$, $I_V$, $I_U$ flowing over one of the windings W, V, U is measured and evaluated for instance; one of the currents $I_W$, $I_V$, $I_U$ is sufficient here. The current $I_W$, $I_V$, $I_U$ is evaluated here immediately after the changeover from motor operation to generator operation of the synchronous motor 9. The current peaks of this current $I_W$, $I_V$, $I_U$ then represent a decisive measure of the load of the laundry drum. In FIG. 2, an exemplary curve of the current $I_W$, $I_V$, $I_U$ flowing over one of the windings W, V, U over the time t is shown immediately after the changeover to the generator operation. As is apparent from the graph according to FIG. 2, the current peaks of the current $I_W$, $I_V$, $I_U$ can be compared with values stored in a memory and as a function of this comparison, the load of the laundry drum can then be determined. For illustration purposes, three value ranges B1, B2, B3 are shown in FIG. 2 for a different load of the laundry drum in each instance. If the current peaks of the current $I_W$, $I_V$, $I_U$ lie in the first value range B1, a small load of the laundry drum is present. The value ranges B2 and B3 are accordingly predetermined for an average or a large load respectively of the laundry drum. A large load of the laundry drum emanates from the current peaks of the current $I_W$, $I_V$, $I_U$ according to FIG. 2.

In order nevertheless to obtain higher resolution and thus increased precision when determining the load, both the intermediate circuit voltage applied to the intermediate circuit capacitor 4 during generator operation and/or an increase in this intermediate circuit voltage and also the current $I_W$, $I_V$, $I_U$ is used in the method. An energy supplied by the synchronous motor 9 within a predetermined time interval during generator operation is calculated from the intermediate circuit voltage and the current $I_W$, $I_V$, $I_U$. Information relating to the current moment of inertia of the laundry drum is then obtained from this energy and the load of the laundry drum is concluded as a function of the moment of inertia. Two possibilities are provided here. The relationship of the moment of inertia to the calculated energy can be modeled by a mathematical formula or it can be modeled by a characteristic curve.

The determination of the unbalance of the laundry drum takes place as a function of a temporal curve of the electrical power supplied by the synchronous motor 9 during generator operation. This power is calculated continuously from the measured values for the current $I_W$, $I_V$, $I_U$ and for the intermediate circuit voltage by means of the control unit 7 and the curve of the power is evaluated in each instance for the duration of a revolution of the laundry drum. Ripples in this curve and/or fluctuations appearing in the curve then represent a measure of the unbalance of the laundry drum.

LIST OF REFERENCE CHARACTERS

1 Circuit arrangement
2 Bridge rectifier
3 DC/DC converter
4 Intermediate circuit capacitor
5 Voltage divider
5*a*, 5*b*, 5*c* Resistors
5*d*, 10*a*, 10*b*, 10*c*, 14*a* Impedance converters
6, 11, 12, 13, 15 Inputs
7 Control unit
7*a* Driver circuit
8 Inverter
8*a*, 8*b*, 8*c* Circuit branches
9 Synchronous motor
10, 14 Measuring facilities
L, N Terminals
T1 to T6 Bipolar transistors
D1 to D6 Diodes
V, W, U Windings
VCC, VDD Supply voltages
$I_W$, $I_V$, $I_U$ Phase currents
$I_{WVU}$ Total current
B1, B2, B3 Value ranges

The invention claimed is:

1. A method for determining a load and/or an unbalance of a laundry drum of a washing machine, comprising the steps of:

driving the laundry drum with an electric motor having a stator with at least one winding coupled to an inverter controlled by a control unit, accelerating the laundry drum to a predetermined rotational speed by operating the electric motor in a motor mode, slowing down the laundry drum by operating the electric motor in a generator mode, while slowing down the laundry drum, measuring at least one parameter selected from the group consisting of an electric current flowing through the at least one winding of the stator and an electric intermediate circuit voltage of the inverter, evaluating a time dependence of electric power supplied by the electric motor operating in generator mode during a revolution of the laundry drum, and determining the load and/or the unbalance from the measured parameter and from the time dependence of the supplied electric power.

2. The method of claim 1, wherein the electric motor is a permanently excited synchronous motor.

3. The method of claim 1, wherein determination of the load and/or the unbalance is started when the electric motor changes over from the motor mode to the generator mode.

4. The method of claim 1, further comprising the steps of:

comparing the measured parameter with a value stored in a memory of the control unit, and determining the load and/or the unbalance in response to a result of the comparing step.

5. The method of claim 1, further comprising the steps of:

calculating energy supplied by the electric motor within a predetermined time interval when slowing down the laundry drum from the measured parameter, and determining the load and/or the unbalance from the calculated energy.

6. The method of claim 5, further comprising the step of modeling, in the control unit, a relationship between the unbalance and/or the load and the calculated energy.

7. The method of claim 6, wherein the relationship is modeled with a mathematical equation.

8. The method of claim 6, wherein the relationship is modeled with a characteristic curve.

9. The method of claim 1, further comprising the steps of:

determining from the measured parameter a moment of inertia of the laundry drum, and determining the load of the laundry drum from the determined moment of inertia.

10. The method of claim 1, wherein the unbalance of the laundry drum is determined from a time dependence of the electric power supplied by the electric motor in the generator mode.

11. The method of claim 10, wherein the unbalance of the laundry drum is determined based on time variations in the supplied electric power during a revolution of the drum.

* * * * *